United States Patent [19]

Galoob

[11] Patent Number: 4,721,489

[45] Date of Patent: Jan. 26, 1988

[54] ILLUMINABLE FIGURINE

[76] Inventor: David Galoob, 335 St. Francis Blvd., San Francisco, Calif. 94127

[21] Appl. No.: 783,001

[22] Filed: Oct. 2, 1985

Related U.S. Application Data

[63] Continuation-in-part of Ser. No. 561,311, Dec. 14, 1983, abandoned.

[51] Int. Cl.[4] ..... A63H 33/36; A63H 3/00

[52] U.S. Cl. ..... 446/23; 446/268

[58] Field of Search ..... 446/23, 485, 22, 268; 272/8 N, 8 R; 362/808

[56] References Cited

U.S. PATENT DOCUMENTS

| | | | |
|---|---|---|---|
| 1,422,075 | 7/1922 | Aronson | 446/23 |
| 1,551,231 | 8/1925 | Aronson | 446/23 |
| 1,938,129 | 12/1933 | Arnold | 446/23 |
| 2,448,906 | 9/1948 | Munao et al. | 272/8 |
| 2,663,971 | 12/1953 | Ippolito | 446/384 |
| 2,748,256 | 5/1956 | Moran | 240/10 |
| 3,525,862 | 8/1970 | Carter et al. | 240/2 |
| 3,531,891 | 10/1970 | Goldfarb et al. | 446/485 X |
| 4,277,338 | 10/1980 | Colquit | 446/295 |
| 4,394,037 | 7/1983 | Kuntz | 446/23 |
| 4,479,326 | 10/1984 | Kennedy et al. | 446/23 |

FOREIGN PATENT DOCUMENTS

| | | | |
|---|---|---|---|
| 467046 | 3/1914 | France | 446/23 |
| 641273 | 7/1928 | France . | |
| 326105 | 3/1930 | United Kingdom | 446/23 |
| 373626 | 5/1932 | United Kingdom | 446/23 |
| 873569 | 7/1961 | United Kingdom . | |
| 1028681 | 5/1966 | United Kingdom . | |
| 1166410 | 10/1969 | United Kingdom | 446/485 |
| 1316230 | 5/1973 | United Kingdom . | |
| 1523719 | 9/1978 | United Kingdom . | |

*Primary Examiner*—Mickey Yu

[57] ABSTRACT

An opaque representation of an animate object has a chest, a chest cavity, a back with a hole formed therethrough, and a section of translucent material in the chest. An intermittent source of illumination is mounted in the hole in the back and produces intermittent flame-like internal illumination in the chest cavity. The illumination is especially pronounced at the translucent section and causes such section to appear to be aflame.

2 Claims, 3 Drawing Figures

ILLUMINABLE FIGURINE

BACKGROUND OF THE INVENTION

This is a Continuation-in-Part of application Ser. No. 561,311, filed Dec. 14, 1983, for ILLUMINABLE FIGURINE, and now abandoned.

The present invention relates to a toy novelty item. More particularly, the invention relates to an illuminable figurine.

Children enjoy playing with figurines representing characters from motion pictures, television, comic books, and so on, since such figurines capture their imagination and permit the children to enact scenarios in which they share the same world with their favorite characters.

The principal object of the invention is to provide an illuminable figurine which provides great pleasure and interest for children playing with and observing it.

An object of the invention is to provide an illuminable figurine which appears to have flames intermittently raging within it.

Another object of the invention is to provide an illuminable figurine representing an animate object which may be intermittently internally illuminated by a person playing with it.

Still another object of the invention is to provide an illuminable figurine representing an animate object having a neck ornamental band which may appear to be aflame intermittently under the control of a person playing with it.

Yet another object of the invention is to provide an illuminable figurine representing a human having a neck ornamental band which may appear to be aflame intermittently under the control of a person playing with it.

Another object of the invention is to provide an illuminable figurine of simple structure, which is inexpensive in manufacture and which is operated with facility, convenience and ease by anyone, including very young children.

BRIEF SUMMARY OF THE INVENTION

In accordance with the invention, an illuminable object comprises an object consisting of substantially opaque material having a section of substantially translucent material and having a cavity therein, the object having a closed back of a determined area and a hole formed through said back and covering less than one third the area of said back, and an intermittent source of illumination mounted in the cavity for internally illuminating the object as desired, the source of illumination comprising a manually-operated device for producing sparks within the cavity and having a manually-operable rotatable wheel extending through the hole, the device producing sparks when operated by manual rotation of the wheel.

In accordance with the invention, an illuminable figurine comprises a figurine consisting of some substantially opaque material and some substantially translucent material and having a cavity therein, the figurine being substantially completely enclosed and having a closed back of a determined area and a hole formed through the back and covering less than one third the area of the back, and intermittent illuminating means mounted in the cavity for internally illuminating the figurine as desired, the illuminating means comprising a manually-operated spark producing device having a manually-operable rotatable wheel extending through the hole and which device produces sparks creating an intermittent flame-like illumination when operated by manual rotation of the wheel.

The figurine has a front and consists of substantially opaque material having a section of substantially translucent material therein in the front.

The figurine is a representation of a substantially human figure.

In accordance with the invention, an illuminable figurine comprises a substantially opaque representation of an animate object having a chest, a chest cavity, a closed back of a determined area and a hole formed through the back and covering less than one third of the area of the back, and a section of substantially translucent material, and an intermittent source of illumination mounted in the cavity and having a rotatable wheel extending through the hole through the back, the source of illumination producing sparks creating intermittent flame-like illumination in the chest cavity under manual rotation of the wheel, the flame-like illumination being visible from outside the figurine at the translucent section.

The representation of an animate object also has a torso with holes formed therein, and extremities movably mounted in the holes.

The translucent section appears to be aflame upon internal illumination of the chest cavity.

In accordance with the invention, an illuminable figurine comprises a substantially opaque representation of a figure of a creature having a chest, a chest cavity, a closed back of a determined area and a hole formed through the back and covering less than one third the area of the back, and an area of substantially translucent material in the figure, and an intermittent source of illumination mounted in the cavity and having a rotatable wheel extending through the hole in the back and producing sparks creating intermittent flame-like internal illumination in the chest cavity under manual rotating of the wheel, especially pronounced and visible from outside the figurine at the area.

The representation of a figure is substantially human and also has a torso with arm holes and thigh holes formed therein, a pair of arms movably mounted in the arm holes and a pair of legs movably mounted in the thigh holes.

The area of substantially translucent material appears to be aflame upon internal illumination of the chest cavity.

BRIEF DESCRIPTION OF THE DRAWINGS

In order that the invention may be readily carried into effect, it will now be described with reference to the accompanying drawings, wherein.

DETAILED DESCRIPTION OF PREFERRED EMBODIMENT

The illuminable figurine of the invention comprises a figurine 1 (FIGS. 1 to 3) having a cavity 2 (FIG. 3) therein. The figurine 1 consists of substantially opaque material of any suitable type such as, for example, substantially rigid plastic 3 (FIG. 3) and is preferably a representation of an animate object or, more particularly, a human figure, as illustrated, although it may be a representation of any object, animate or inanimate.

Figure 2:
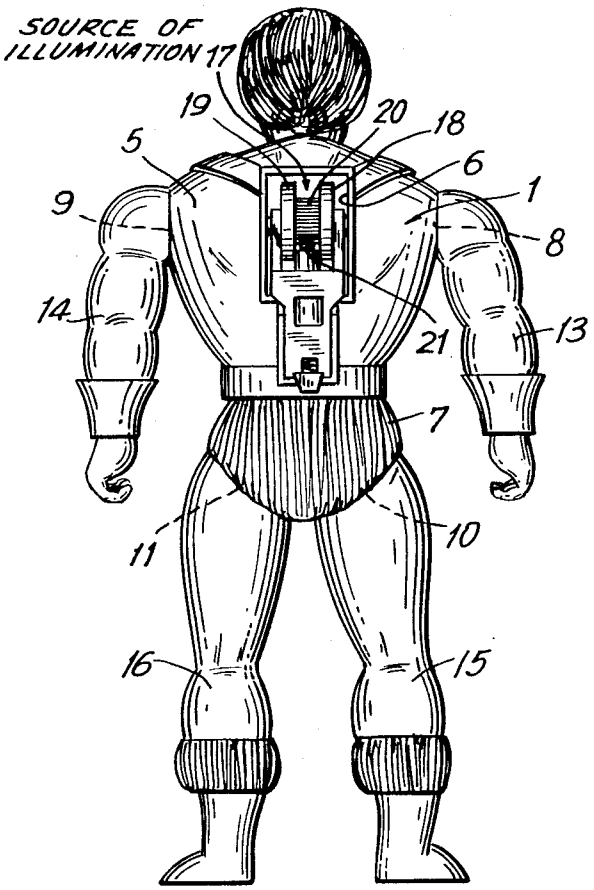
FIG. 2 is a rear view of the embodiment of FIG. 1.

In the illustrated embodiment of the invention, the figurine 1 is a representation of a human figure and has a chest 4 (FIGS. 1 and 3), a chest cavity 2 (FIG. 3) and a closed back 5 of a determined area (FIGS. 2 and 3) with a hole 6 formed therethrough (FIG. 2). The hole 6 formed through the back 5 covers less than one third the area of said back. The figurine 1 also has a torso 7 (FIGS. 1 to 3) with arm holes 8 and 9 (FIGS. 1 and 2) and thigh holes 10 and 11 (FIGS. 1 and 2).

An ornamental neck band 12 (FIG. 1) of substantially translucent material of any suitable type such as, for example, substantially rigid, substantially clear, plastic, is provided in the chest 4.

Figure 1:
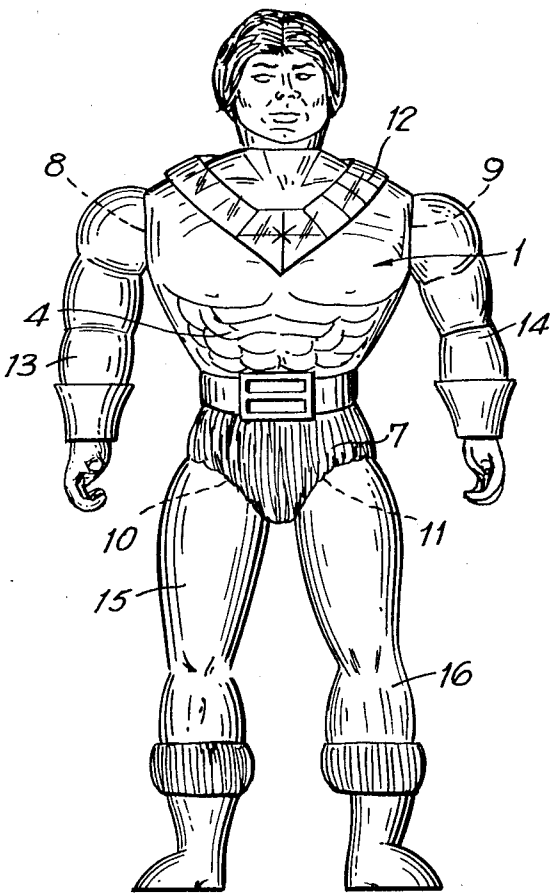
FIG. 1 is a front view of an embodiment of the illuminable figurine of the invention.

A pair of arms 13 and 14 are movably mounted in the arm holes 8 and 9, respectively (FIGS. 1 and 2), and a pair of legs 15 and 16 are movably mounted in the thigh holes 10 and 11, respectively (FIGS. 1 and 2).

In accordance with the invention, an intermittent source of illumination 17 (FIGS. 2 and 3) is mounted in the hole 6 in the back 5 and produces intermittent flame-like internal illumination in the chest cavity 2. This illumination is especially pronounced, and visible from outside the figurine 1, at the neck band 12. The source of illumination 17 may comprise any suitable, commercially available, intermittent source of illumination known in the art such as, for example, a manually-operated spark producing device which produces intermittent flame-like illumination and causes the neck band 12 to appear to be aflame. A suitable spark producing device may comprise, for example, a Spark Wheel, Flint, Spring for Plastic Lighter manufactured by the Warriors Industrial Company Ltd., Block E and F, 5/F. Winfield Industrial Building, 3 Kin Kwan Street, Tsun Mun, N.T., Hong Kong.

Figure 3:
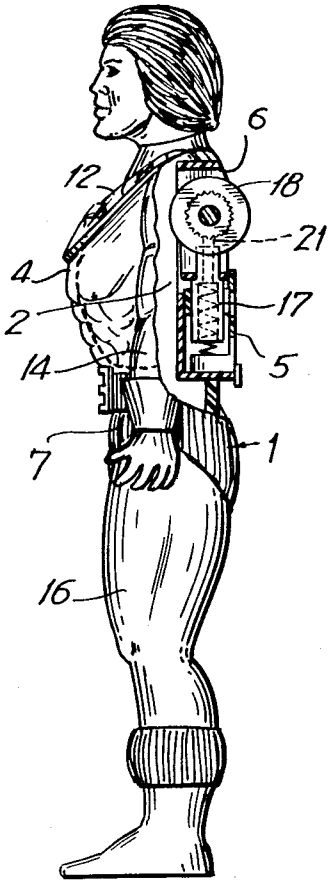
FIG. 3 is a side view, partly cut away and partly in section, of the embodiment of FIG. 1.

The known source of illumination 17 illustrated in FIGS. 2 and 3 is manually-operated by a finger of a person playing with the figurine 1. This is accomplished by rotating wheels 18 and 19 (FIG. 2) whereby there is a frictional contact between a relative rough surface 20 (FIG. 2) between and rotating with said wheels and a flint-like component 21 (FIG. 2) which is spring-biased into friction with said rough surface. The wheels 18 and 19 extend through the hole 6. The result is the production, in the chest cavity 2, of an intermittent flame-like illumination of the neck band 12 when the wheels 18 and 19 are manually rotated.

While the invention has been described by means of a specific example and in a specific embodiment, I do not wish to be limited thereto, for obvious modifications will occur to those skilled in the art without departing from the spirit and scope of the invention.

I claim:

1. An illuminable figurine, comprising a substantially opaque representation of one of a human, human-type, animal and animal-type creature having a torso having a chest having a section of substantially translucent material, a chest cavity, a closed back of a determined area and a hole formed through said back and covering less than one third of the area of said back; and an intermittent source of illumination mounted in said cavity and having a rotatable wheel extending through said hole through said back, said source of illumination producing sparks creating intermittent flame-like illumination in said chest cavity under manual rotation of said wheel, said flame-like illumination being visible from outside said figurine at said translucent section, whereby said translucent section appears to be aflame upon internal illumination of said chest cavity.

2. An illuminable figurine as claimed in claim 1, wherein said representatin of a figure is substantially human and said torso has arm holes and thigh holes formed therein, a pair of arms movably mounted in said arm holes and a pair of legs movably mounted in said thigh holes.

* * * * *